US008137481B2

(12) United States Patent
Jensen et al.

(10) Patent No.: US 8,137,481 B2
(45) Date of Patent: Mar. 20, 2012

(54) TANK CLEANING APPARATUS

(75) Inventors: Bo Boye Busk Jensen, Rodovre (DK); Rene Elgaard, Hombaek (DK)

(73) Assignee: Alfa Laval Corporate AB, Lund (SE)

( * ) Notice: Subject to any disclaimer, the term of this patent is extended or adjusted under 35 U.S.C. 154(b) by 390 days.

(21) Appl. No.: 12/495,221

(22) Filed: Jun. 30, 2009

(65) Prior Publication Data

US 2010/0326482 A1 Dec. 30, 2010

(51) Int. Cl.
*B08B 3/02* (2006.01)

(52) U.S. Cl. ..... 134/167 R; 134/168 R; 134/198

(58) Field of Classification Search ..... 134/167 R, 134/168 R, 198
See application file for complete search history.

(56) References Cited

U.S. PATENT DOCUMENTS

| | | | | |
|---|---|---|---|---|
| 240,833 | A * | 5/1881 | Martin et al. | 239/559 |
| 1,996,159 | A * | 4/1935 | Kittredge | 239/452 |
| 2,688,894 | A * | 9/1954 | Modrey | 411/34 |
| 2,954,038 | A * | 9/1960 | Girard | 134/167 R |
| 2,991,203 | A * | 7/1961 | In T Veld et al. | 134/24 |
| 3,121,536 | A * | 2/1964 | McKibben | 239/253 |
| 3,825,022 | A * | 7/1974 | Metz | 134/104.1 |
| 4,030,513 | A * | 6/1977 | McKenzie | 134/167 R |
| 5,096,122 | A * | 3/1992 | Abramoska | 239/252 |
| 5,316,218 | A * | 5/1994 | Bowen | 239/246 |
| 7,063,274 | B2 | 6/2006 | Feller et al. | |
| 7,718,013 | B2 | 5/2010 | Jonsson | |
| 2001/0017147 | A1 * | 8/2001 | Gazewood | 134/22.12 |
| 2001/0017323 | A1 | 8/2001 | Feller et al. | |
| 2009/0114741 | A1 | 5/2009 | Maxime et al. | |

FOREIGN PATENT DOCUMENTS

| | | | |
|---|---|---|---|
| EP | 0 745 437 | | 12/1996 |
| FR | 2 500 334 | | 8/1982 |
| GB | 2 188 255 | | 9/1987 |
| GB | 2 271 068 | | 4/1994 |
| JP | 09-174007 | * | 7/1997 |
| SU | 707808 | * | 1/1981 |

OTHER PUBLICATIONS

International Search Report and Written Opinion dated Oct. 21, 2010, corresponding to International Appln. No. PCT/SE2010/050679.

Document describing the SaniMidget™ Rotary Spray Head, available from Alfa Laval™.

* cited by examiner

*Primary Examiner* — Frankie L Stinson
(74) *Attorney, Agent, or Firm* — Fish & Richardson P.C.

(57) ABSTRACT

A cleaning device for cleaning of the inside of tanks and similar containers by a cleaning fluid, the cleaning device including a connector part for connecting the cleaning device to a piping system, a rotor part rotatably arranged relative to the connector part and a holding part for rotatably holding the rotor part adjacent to relative to the connector part, and where the holding part is provided with a first holding arrangement which co-operates with a corresponding second holding arrangement on the connector part releasably hold the holding part to the a connector part, where the holding part can rotated around its longitudinal direction between a holding position and a releasing position.

15 Claims, 3 Drawing Sheets

Fig. 1
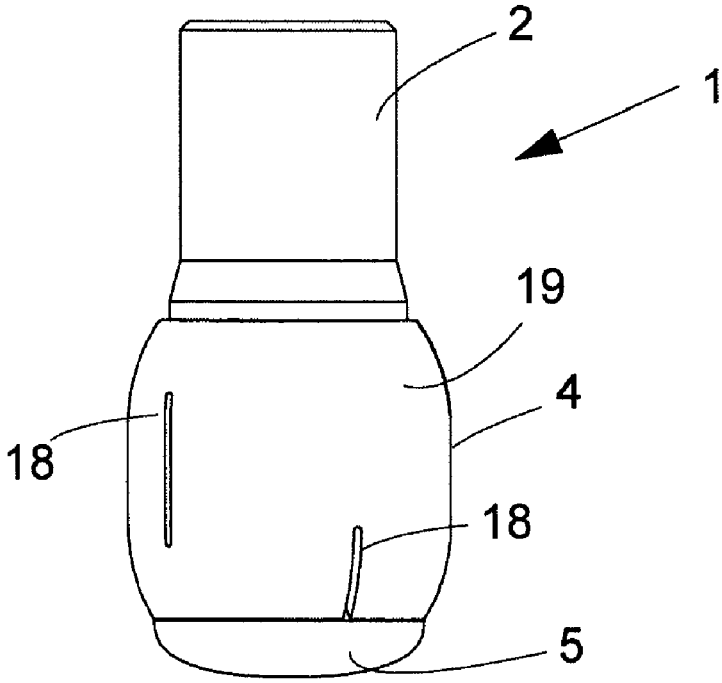
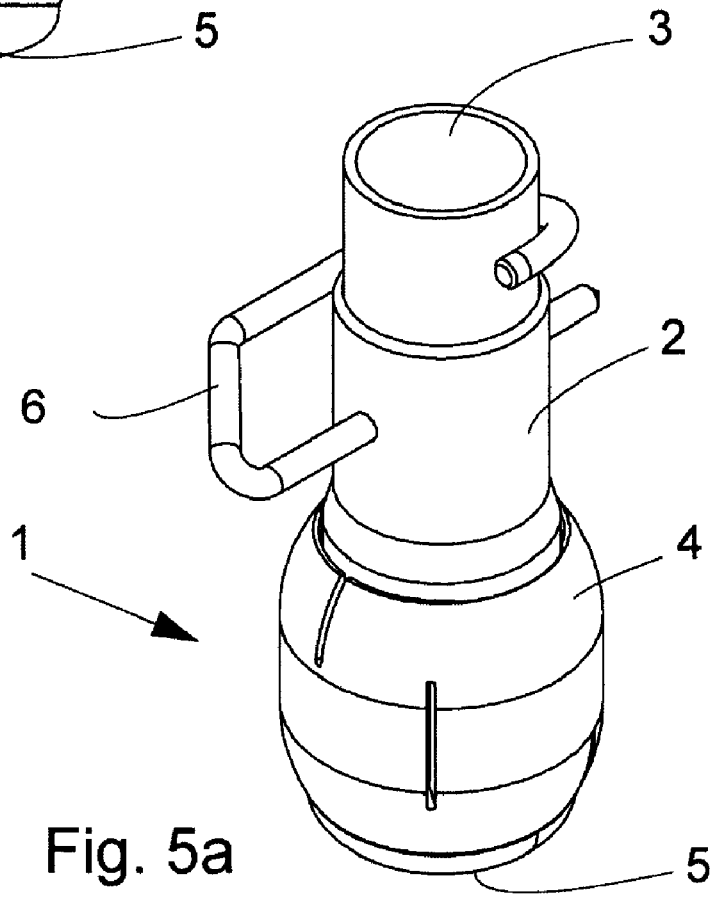
Fig. 5a

Fig. 2a
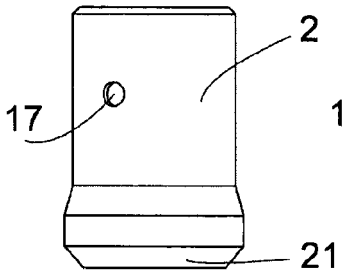
Fig. 2b
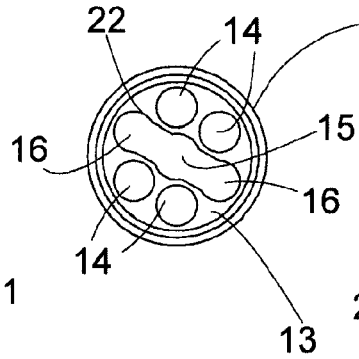
Fig. 2c
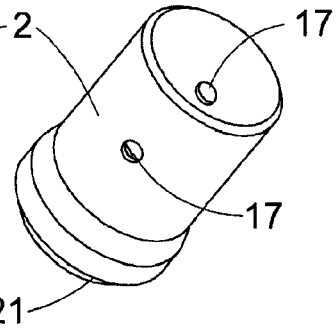
Fig. 3a
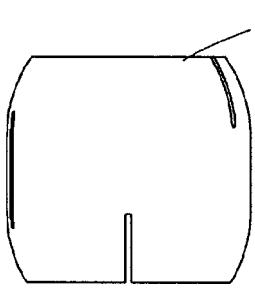
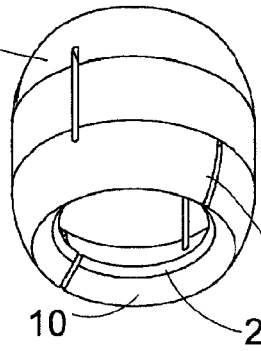
Fig. 3b
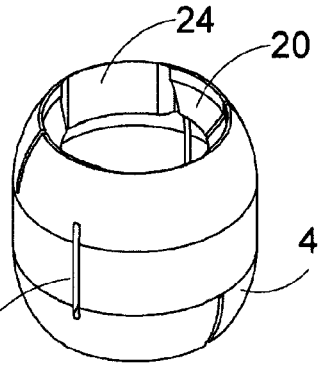
Fig. 3c
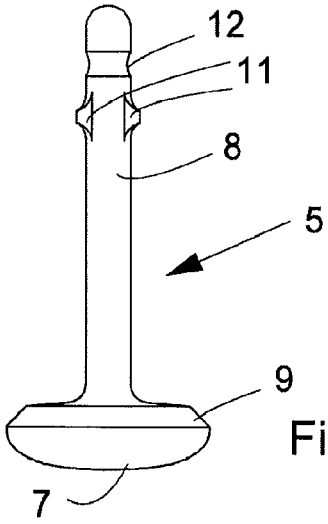
Fig. 4

TANK CLEANING APPARATUS

FIELD OF THE INVENTION

The present invention relates to a device for cleaning of the inside of tanks and similar containers, more specifically to a tank cleaning device having a sanitary design with an easy mounting system design to prevent the device from self-disassembling when dismounted from down-pipe.

BACKGROUND OF INVENTION

Conventionally, equipment for the cleaning of the inside of tanks and similar containers are mounted on a down-pipe coming through the top of the tank. The equipment comprises a down-pipe, which extends into the tank and on which there is mounted cleaning equipment. The cleaning equipment is connected to a piping system for the supply of cleaning fluid. The supply of cleaning fluid to the cleaning head rotates the cleaning head since the cleaning head is provided with slots through which the cleaning fluid is guided and the design of the slots creates the rotational movement. The cleaning fluid lays fans in a swirling pattern throughout the tank.

This type of cleaning equipment is normally used for the cleaning of tanks when they are empty. By the design of the slots of the cleaning head different spray patterns can be achieved, e.g. 360°, 270° up or 180 down. The equipment can be mounted either in a permanent manner or it can be mounted when taken into use. By the flow of cleaning fluid through the cleaning equipment, the cleaning equipment is self-cleaned.

One example of the above mentioned cleaning equipment is the SaniMidget Rotary Spray Head from Alfa Laval, where the rotary spray head includes a connector part for connecting to the down-pipe and a rotor part, rotatable arranged on the connector part. The connector part is connected to the down-pipe by a spring clip. Rotor part or rotating head is fitted into the connector part and welded onto a rotor part. The rotor part is resting on a number of balls (the bearing surface). This is a non-dismountable design due to the welding.

Another cleaning device is known from US-B2-7 063 274, where a cleaning nozzle is disclosed, where the nozzle includes a nozzle body arranged between a bearing element and a securing element, and where the nozzle body is rotatably supported by the bearing element and the securing element. The nozzle body can be secured either by screwing the bearing element onto the securing element or by having a spring plug to secure the bearing element onto the securing element.

The problem with the prior art solution is that the design of them does not fulfill the 3A requirements of a hygienic design, stating that a cleaning device should be possible to dismount and that it should not be completely cleanable and without possible non-cleanable spaces.

SUMMARY OF THE INVENTION

An object of the present invention is to provide a cleaning device which overcomes the problems with prior art solutions.

The objective is achieved by a cleaning device for cleaning of the inside of tanks and similar containers by a cleaning fluid, the cleaning device including a connector part for connecting the cleaning device to a piping system, a rotor part rotatably arranged relative to the connector part and a holding part for rotatably holding the rotor part adjacent to relative to the connector part, characterized in that the holding part is provided with at least one first holding arrangement which co-operates with a corresponding second holding arrangement on the connector part releasably hold the holding part to the a connector part, where the holding part can rotated around its longitudinal direction between a holding position and a releasing position.

According to a first aspect of the claimed invention through holes arranged on the connector part and the holding part are aligned in the holding position enabling the cleaning device to be mounted onto a piping system and be secured by a clip which extends through holes of the piping system and through the aligned holes of the cleaning device.

According to a further aspect of the claimed invention the at least one first holding arrangement in the holding position rests on the peripheral of the second holding arrangement, and where the at least one first holding arrangement in the releasing position be insert or released through or the second holding arrangement.

According to another aspect of the claimed invention the rotation of the holding part around its longitudinal direction between the holding position and the releasing position is in the range between 45°-135°, with a preferred rotation of about 90°.

According to yet another aspect of the claimed invention the at least one first holding arrangement are at least one protrusion extending on one side of an elongated portion of the holding part, and where the elongated portion connects to a base portion for rotatably holding the rotor part in an end of the elongated portion opposite to the location of the at least one protrusion.

According to a further aspect of the claimed invention the second holding arrangement are a center hole of the connector part extending along the longitudinal direction of the connector part and provided with at least two side-arms extending on opposite sides of the center hole, where the at least two side-arms corresponds to the at least one protrusion of the holding part, and where in the releasing position the at least two side-arms enables the at least one protrusion of the holding part to be inserted into or released from the connector part.

According to still another aspect of the claimed invention the at least one first holding arrangement are two protrusions extending on opposite sides of an elongated portion of the holding part.

According to second aspect of the claimed invention the holding part includes a base portion for rotatably holding the rotor part and an elongated portion extending perpendicular from the base portion, where the elongated portion is provided in the end opposite to the base portion with at least one protrusion extending on one side of the elongated portion and a through hole.

According to another aspect of the claimed invention the through hole is located closer to end of the elongated portion than the at least one protrusion, and where the extension of the at least one protrusion deviates from the extension of the through hole in same horizontal plane in the range between 45°-135°, with a preferred deviation of about 90°.

According to yet another aspect of the claimed invention connector part includes a center hole extending along the longitudinal direction of the connector part and provided with at least two side-arms extending on opposite sides of the center hole, and where a peripheral wall of the connector part is provided with two through holes arranged opposite to each other, and where the joint extension of the at least two side-arms deviates from the extension of the aligned through holes in parallel horizontal planes in the range between 45°-135°, with a preferred deviation of about 90°.

According to still another aspect of the claimed invention the elongated portion is provided in the end opposite to the base portion with at least two protrusions extending on opposite sides of the elongated portion and a through hole.

A further object of the invention is to rotatably holding the rotor part of the cleaning device.

This objective is achieved by a cleaning device according to the claimed invention wherein the base portion of the holding part and the connector part are provided a chamfered bearing surface on an outer peripheral that co-operates with corresponding chamfered surfaces on inner peripheral ends of the rotor part.

A further object of the invention is to enabling flow control of the volumetric flow to the rotor part of the cleaning device.

This objective is achieved by a cleaning device according to the claimed invention, wherein the connector part is provided with a cover portion extends over the cross section of the connector part, and where the cover portion is provided holes.

According to still another aspect of the claimed invention the dimension of some of the holes can be adjusted to control of the flow of cleaning fluid to the rotor part.

Further aspects of the invention is apparent from the dependent claims and the description.

BRIEF DESCRIPTION OF THE DRAWINGS

Further objects, features and advantages will appear from the following detailed description of several embodiments of the invention with reference to the drawings, in which:

FIG. 1 is a side view of a cleaning device according to the present invention;

FIGS. 2*a*-2*c* are different views of a connector part of the cleaning device according to the present invention;

FIG. 3*a*-3*c* are different views of a rotor part of the cleaning device according to the present invention;

FIG. 4 is a side view of the stator part of the cleaning device according to the present invention;

FIGS. 5*a*-5*b* are perspective views of the cleaning device according to the present invention mounted onto a down-pipe and FIGS. 6*a*-6*b* are side views of the cleaning device according to the present invention mounted onto a down-pipe.

DETAILED DESCRIPTION

Figure 6A:
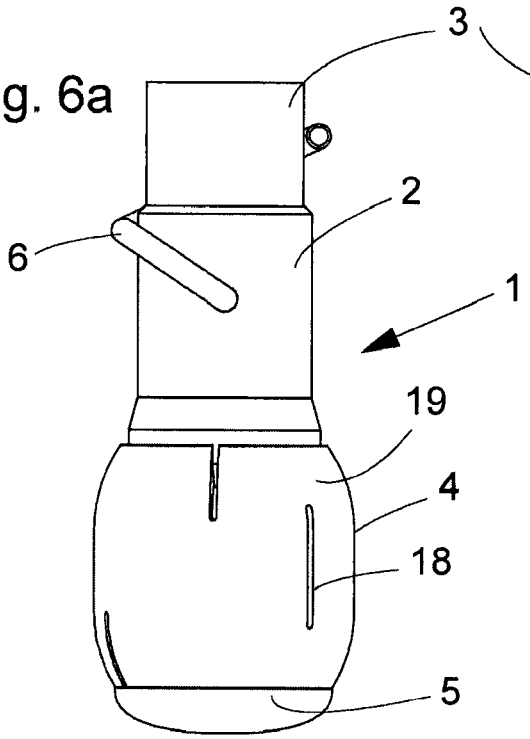
Figure 6B:
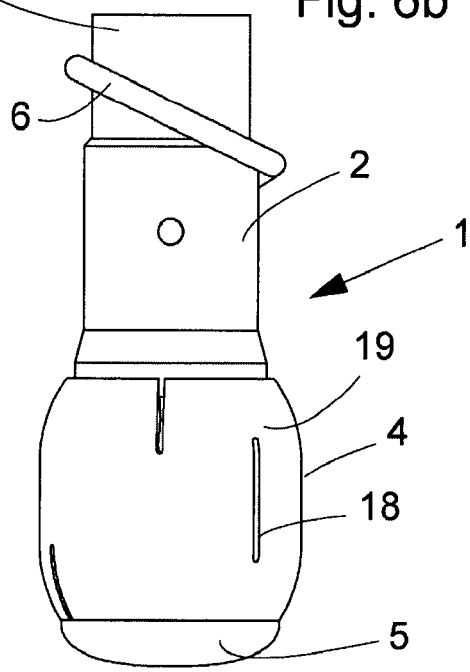
Figure 5B:
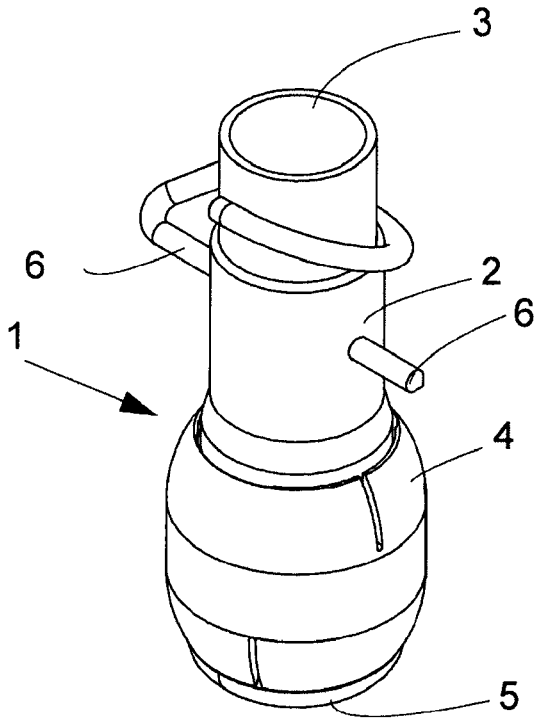

In FIG. 1 a cleaning device or rotary spray head 1 is shown having a connector part 2 for connecting to the down-pipe 3, a spray head or rotor part 4, which rotor 4 is rotatably arranged in relation to the connector part 2, and a bottom or stator part 5 for removably and rotatably holding the rotor part 4 to the connector part 2. The connector part 2 is removably connected to the down-pipe 3 by a clip 6.

In FIG. 4 the stator part 5 is shown having a base portion 7 and a substantially circular elongated portion 8, where the base portion 7 rotatably holds rotor part 4 and the elongated portion 8 extends through the rotor part 4 and into the connector part 2 to attach the stator part 5 to the connector part 2. The base portion 7 is circular shaped having a chamfered surface 9 along the outer periphery which co-operate with a corresponding chamfered surface 10 inner periphery of the rotor part 4. The elongated portion 8 of the stator part 5 has a length to extend through the rotor part 4 and into the connector part 2. In the end of the elongated portion 8 directed away from the base portion 7 is provided two protrusions 11 aligned with a through-hole 12, where the protrusions 11 extends substantially perpendicular from the elongated portion 8 and arranged on opposite sides of the elongated portion 8.

In FIG. 2*b* a bottom view of the circular connector part 2 is shown with a cover portion 13, partially cover the interior cross-section area of the connector part 2. The cover portion 13 is provided with side holes 14 and a center hole 15 for allowing passage of the cleaning fluid and for adjustment of volumetric flow rate to the rotor 4. The center hole 15 is provided with side-arms 16 for enabling the stator part 5 and the protrusions 11 of the elongated portion 8 of the stator part 5 to pass by the cover portion 13. In FIG. 2*c* the connector part 2 is shown having one hole 17 on opposite sides of the peripheral wall 18 of the connector part 2. The holes 17 serve to receive the clip 6, when the connector part is mounted onto the down-pipe 3. The hole 12 of the stator part 5 is also aligned with the holes 17, when the elongated portion 8 of the stator part 5 is inserted into connector part 2 and in position to receive the clip 6.

The hole 12 and the protrusions 11 of the elongated portion 8 of the stator part 5 are arranged in accordance with the extension of the side-arms 16 of the center hole 15 and the holes 17 of the connector part 2 so that the stator part 5 needs to be rotated after the protrusions 11 of the stator part 5 have passed or entered through the center hole 15 of the connector part 2 to enable the hole 12 of the stator part 12 to be aligned with the holes 17 of the connector part 2. In preferred embodiment the stator part 5 needs to be rotated 90° around to its longitudinal extension after it has passed the center hole 15 of the connector part 2, but other values are also possible.

The rotor part 4, which is shown in FIGS. 3*a*-3*c*, is a substantially cylindrical having slots, slits or openings 18 on its peripheral surface 19, which serves as outlets for the cleaning fluid. The slots, slits or openings 18 are arranged on the peripheral surface 19 so that the rotor part 4 is rotated by the pressure from the cleaning fluid. By the design of the slots, slits or openings 18 of the rotor part 4 different spray patterns can be achieved, e.g. 360°, 270° up or 180 down, to efficiently clean the interior of the tank in which the rotary spray head 1 is mounted. As mentioned above the rotor part 4 is provided with a chamfered surface 10 at the inner periphery of the end of the rotor part 4 resting on the stator part 5, but it also provided a corresponding chamfered surface 20 at the inner periphery of the end of the rotor part 4 closest to the connector part 2 and which co-operates with a corresponding chamfered surface 21 (see FIGS. 2*a* and 2*c*) located at the outer periphery of the connector part 2. To guide the cleaning fluid into the passage between chamfered surfaces 10 and 9 a second chamfer surface 23 is provided above the chamfered surface 10 in the lower end of the rotor part 4. The second chamfer surface 23 has a different angle than chamfered surface 10. In the upper end of the rotor part 4, two cut-outs or slots 24 are provided on opposite sides of the inside of the rotor part. These cut-outs or slots 24 removes some of the bearing surface 20 and guarantees that water is thrown directly up along the down-pipe 3 for self cleaning purposes and for cleaning the tank wall above the cleaning machine 1.

The assembly and functionality of the cleaning device or rotary spray head 1 according to invention is as follows:

1. Insert the cylindrical end (the elongated portion 8) of the stator part 5 through the rotor part 4.
2. The cylindrical end (the elongated portion 8) of the stator part 5 is then inserted into the centre hole 15 of the connector part 2. The stator part 5 can only be inserted to its full extent in one position only—the protrusions 11 on each side of the stator part 5 slides through the side-arms 16 of the centre hole 15 of the connector part 2. When the stator part 5 is fully inserted into the connector part 2 the rotor part 4 it will be locked in place between the chamfered bearing surfaces 9, 21 of the stator part 5 and connector part 2.

3. After having inserted the stator part 5 into the connector part 2 the stator is turned 90° around its longitudinal direction so that the hole 12 in the cylindrical end (elongated portion 8) of the stator part 5 is aligned with the holes 17 in the connector part 2 (this makes it possible to install the cleaning device 1 on the down pipe 3 using a clip 6). This ensures that the stator part 5 cannot fall out of the connector part 2 if the clip 6 is removed and the machine is only held by hand at the connector part 2. Instead the protrusions 11 will fall onto the edge 22 (see FIG. 2*b*) of the centre hole 15 in the connector part 2. The stator part 5 cannot be with-drawn from the connector part 2 unless the stator part 5 is turned back 90° around its longitudinal direction so the protrusions 11 can slide through the side-arms 16 of the connector part 2.

4. Finally the cleaning device 1 is held in the hand of the assembler (a hand below the stator) to slide the cleaning device 1 onto the down-pipe 3. Align the holes 12, 17 for the clip 6 on the connector part 2 with holes 23 for the clip 6 on the down pipe 3 while mounting the clip 6 through the holes 12, 17, 23 in the connector part 2, the down pipe 3, the stator part 5, the other side of the down pipe 3 and finally out through the other side of the connector part 2.

In the above embodiment is has been described as the elongated part of the stator part is provided with two protrusions that co-operates with the two side-arms of the center hole of the connector part, but theoretically it is also possible to have three or four protrusions and corresponding side-arms. It is also possible to have only one protrusion, and one or two side-arms.

In the above it is assumed that the though-hole and protrusions of the elongated of the stator part are aligned, and also that the extension of the holes of connector part and the extension of the side-arms deviates from each other in the range between 45°-135°, preferably perpendicular to each other. Other variations are also possible as long as the protrusions are not aligned with the side-arms in the mounted position.

In the described embodiment it is assumed that the connector part is mounted onto the down-pipe, but it is also to use invention for a weld-on solution, where the connector part is welded directly onto the down-pipe. Then the clip goes through holes of the connector part and the stator part only.

The invention is not limited to the embodiments described above and shown on the drawings, but can be supplemented and modified in any manner within the scope of the invention as defined by the enclosed claims.

What is claimed is:

1. A cleaning device for cleaning of the inside of tanks and similar containers by a cleaning fluid, the cleaning device comprising:

a connector part for connecting the cleaning device to a piping system, a rotor part rotatably arranged relative to the connector part, and a holding part for rotatably holding the rotor part adjacent to the connector part, wherein the holding part is provided with at least one first holding arrangement which co-operates with a corresponding second holding arrangement on the connector part to releasably hold the holding part to the connector part, wherein the holding part is arranged to rotate around its longitudinal axis between a holding position and a releasing position, wherein through holes arranged on the connector part and the holding part are aligned in the holding position enabling the cleaning device to be mounted onto a piping system and be secured by a clip which extends through holes of the piping system and through the aligned through holes of the cleaning device, and wherein the at least one first holding arrangement in the holding position rests on a periphery of the second holding arrangement, and wherein the at least one first holding arrangement in the releasing position is able to be inserted into or released through or the second holding arrangement.

2. A cleaning device according to claim 1, wherein the rotation of the holding part around its longitudinal axis between the holding position and the releasing position is in the range between 45°-135°.

3. A cleaning device according to claim 2, wherein the at least one first holding arrangement comprises at least one protrusion extending on one side of an elongated portion of the holding part, and wherein the elongated portion connects to a base portion for rotatably holding the rotor part in an end of the elongated portion opposite to the location of the at least one protrusion.

4. A cleaning device according to claim 3, wherein the second holding arrangement comprises a center hole of the connector part extending along the longitudinal axis of the connector part and at least two side-arms extending on opposite sides of the center hole, wherein the at least two side-arms correspond to the at least one protrusion of the holding part, and wherein, in the releasing position, the at least two side-arms enable the at least one protrusion of the holding part to be inserted into or released from the connector part.

5. A cleaning device according to claim 4, wherein the at least one first holding arrangement comprises two protrusions extending on opposite sides of an elongated portion of the holding part.

6. A cleaning device according to claim 2, wherein rotation of the holding part around its longitudinal axis between the holding position and the releasing position is about 90°.

7. A cleaning device according to claim 1, wherein the holding part comprises:

a base portion for rotatably holding the rotor part; and an elongated portion extending perpendicular from the base portion, wherein the elongated portion is provided in an end opposite to the base portion with at least one protrusion extending on one side of the elongated portion and a through hole.

8. A cleaning device according to claim 7, wherein the through hole is located closer to an end of the elongated portion than the at least one protrusion, and wherein an extension of the at least one protrusion deviates from an extension of the through hole in a same horizontal plane in the range between 45°-135°.

9. A cleaning device according to claim 8, wherein the extension of the at least one protrusion deviates from the extension of the through hole by about 90°.

10. A cleaning device according to claim 7, wherein the connector part comprises:

a center hole extending along the longitudinal axis of the connector part; and at least two side-arms extending on opposite sides of the center hole, wherein a peripheral wall of the connector part is provided with two through holes arranged opposite to each other, and wherein a joint extension of the at least two side-arms deviates from an extension of the aligned through holes in parallel horizontal planes in the range between 45°-135°.

11. A cleaning device according to claim 10, wherein the joint extension of the at least two side-arms deviates from the extension of the aligned through holes in parallel horizontal planes by about 90°.

12. A cleaning device according to claim 7, wherein the elongated portion is provided in an end opposite to the base portion with at least two protrusions extending on opposite sides of the elongated portion and a through hole.

13. A cleaning device according to claim 1, wherein the base portion of the holding part and the connector part are provided with a chamfered bearing surface on an outer periphery that co-operates with corresponding chamfered surfaces on inner peripheral ends of the rotor part.

14. A cleaning device according to claim 1, wherein the connector part has a cover portion that extends over a cross section of the connector part, and wherein the cover portion has holes.

15. A cleaning device according to claim 1, wherein a dimension of some of the holes can be adjusted to control of a flow of cleaning fluid to the rotor part.

* * * * *

UNITED STATES PATENT AND TRADEMARK OFFICE

CERTIFICATE OF CORRECTION

PATENT NO. : 8,137,481 B2
APPLICATION NO. : 12/495221
DATED : March 20, 2012
INVENTOR(S) : Bo Boye Busk Jensen and Rene Elgaard It is certified that error appears in the above-identified patent and that said Letters Patent is hereby corrected as shown below:

Title page, column 1, item (75); (Inventors), line 2, delete “Hombaek” and insert --Hornbaek--.

Title page, column 2, item (57); (Abstract), line 10, delete “the a” and insert --the--.

Signed and Sealed this
Twenty-sixth Day of June, 2012

David J. Kappos

David J. Kappos
*Director of the United States Patent and Trademark Office*